United States Patent [19]

Rostron

[11] 4,079,216

[45] Mar. 14, 1978

[54] CLOSING-RESISTOR SUPPORT FOR EHV POWER CIRCUIT-BREAKERS

[75] Inventor: Joseph R. Rostron, Monroeville, Pa.

[73] Assignee: Westinghouse Electric Corporation, Pittsburgh, Pa.

[21] Appl. No.: 608,480

[22] Filed: Aug. 28, 1975

[51] Int. Cl.[2] ..... H01H 33/16

[52] U.S. Cl. ..... 200/144 AP; 200/146 R; 200/148 R

[58] Field of Search ..... 200/144 AP, 146 R, 148 R

[56] References Cited

U.S. PATENT DOCUMENTS

| | | | |
|---|---|---|---|
| 3,291,947 | 12/1966 | Van Sickle | 200/144 AP |
| 3,390,239 | 6/1968 | Miller | 200/146 R |
| 3,435,166 | 3/1969 | Barkan | 200/144 AP |
| 3,482,069 | 12/1969 | Badey et al. | 200/144 AP |

*Primary Examiner*—Robert S. Macon
*Attorney, Agent, or Firm*—W. R. Crout

[57] ABSTRACT

An improved closing resistor support is provided for the closing resistances of high-voltage high-power compressed-gas circuit-interrupters in which the formerly-used insulating straps are completely eliminated, and consequently the voltage conditions are thereby improved to thus withstand a much higher-voltage breakdown capability during the closing operation.

A metallic ring is preferably utilized at the front end of the circular closing resistance assemblage and provides a uniform compression of the individual resistor coils and, additionally, provides a desirable electrical field condition at the resistor assemblage.

5 Claims, 7 Drawing Figures

FIG. 1.
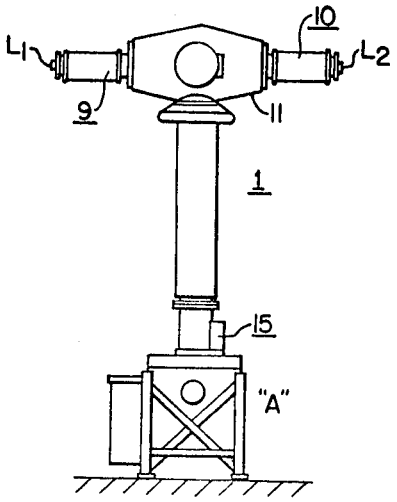
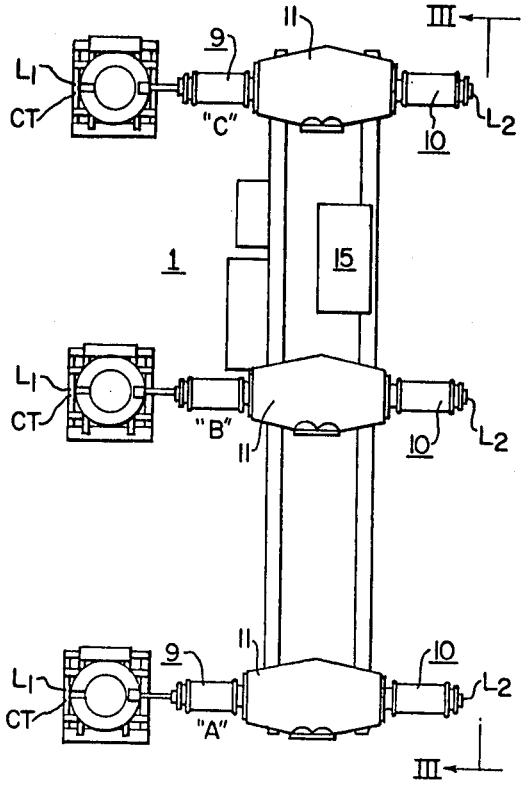
FIG. 2.
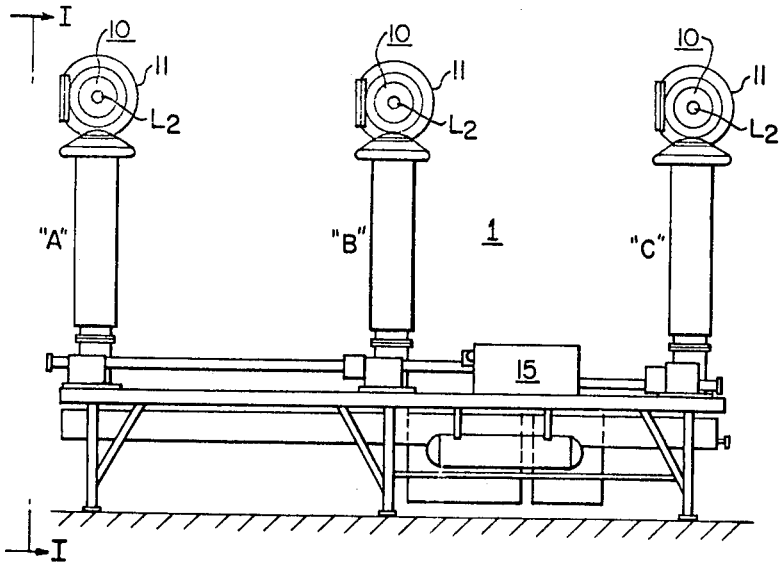
FIG. 3.

CLOSING OPERATION
(NO ARCING)

CLOSING-RESISTOR SUPPORT FOR EHV POWER CIRCUIT-BREAKERS

CROSS-REFERENCES TO RELATED APPLICATIONS

Applicant is not aware of any related patent application pertinent to the present invention.

BACKGROUND OF THE INVENTION

In U.S. Pat. No. 3,291,947, issued Dec. 13, 1966, to Roswell C. Van Sickle, entitled "Interrupting Structures For Compressed-Gas Circuit-Interrupters Having Double-Break Hollow Rotative Moving Contact-Arm Assembly", and assigned to the assignee of the instant application, there is illustrated and described an improved high-power compressed-gas circuit-interrupter in which a double-break rotating contact-arm construction is used, and wherein two closing resistances are inserted into the circuit for each module during the closing operation to thereby damp voltage surges occurring on the connected transmission line. During the opening operation of the circuit-breaker, however, such closing resistances are not inserted into the circuit, and have no function whatsoever as set forth in said patent. A movable resistor contact, interposed in the path of the closing movement of the rotatable cross-arm, electrically connects the two closing resistances into the circuit during the closing operation prior in point of time to the subsequent closing of the two main moving contacts associated with the main rotatable cross-arm assembly.

Former supporting constructions of the closing resistance have been cumbersome, and have employed heavy insulating straps, which are somewhat susceptible to voltage breakdown, and thereby tend to limit the voltage breakdown capability of the interrupter during the closing operation while the resistor is inserted into the circuit.

SUMMARY OF THE INVENTION

In accordance with the present invention there is provided an improved closing-resistor support involving a generally cone-shaped, or truncated metallic plate structure having its central hub-portion fixedly secured to the inner protruding stationary end of the terminal-bushing stud, and extending diagonally rearwardly to the rear end of the closing-resistance assemblage. The circularly arranged closing resistance itself involves, preferably a plurality of aligned insulating troughs, within which are circularly placed zigzag resistor coils, for example.

At the front end of the closing resistor assemblage there is provided merely a circular metal compression ring, which is electrically connected, preferably by a shunt connection, to the movable rotatable resistor contact. The latter, as in prior-art constructions, is contacted during the closing operation, and its pivotal nature and characteristics are such that during the opening operation, it has a desired time lag, and therefore the resistor assemblage is out of the electrical circuit during the opening operation of the breaker. All of the formerly-used heavy insulating straps are eliminated with the substitution therefor of the new resistor-support construction and arrangement of the present invention.

BRIEF DESCRIPTION OF THE DRAWINGS

FIG. 1 is a side-elevational view of an end pole-unit of a three-phase circuit-interrupting structure;

FIG. 2 is a top plan view looking downwardly upon the three pole-units of the three-phase interrupting assemblage of FIG. 1;

FIG. 3 is a side-elevational view of the three pole-units of the three-phase interrupting assemblage of FIGS. 1 and 2;

DESCRIPTION OF THE PREFERRED EMBODIMENT

Figure 4:
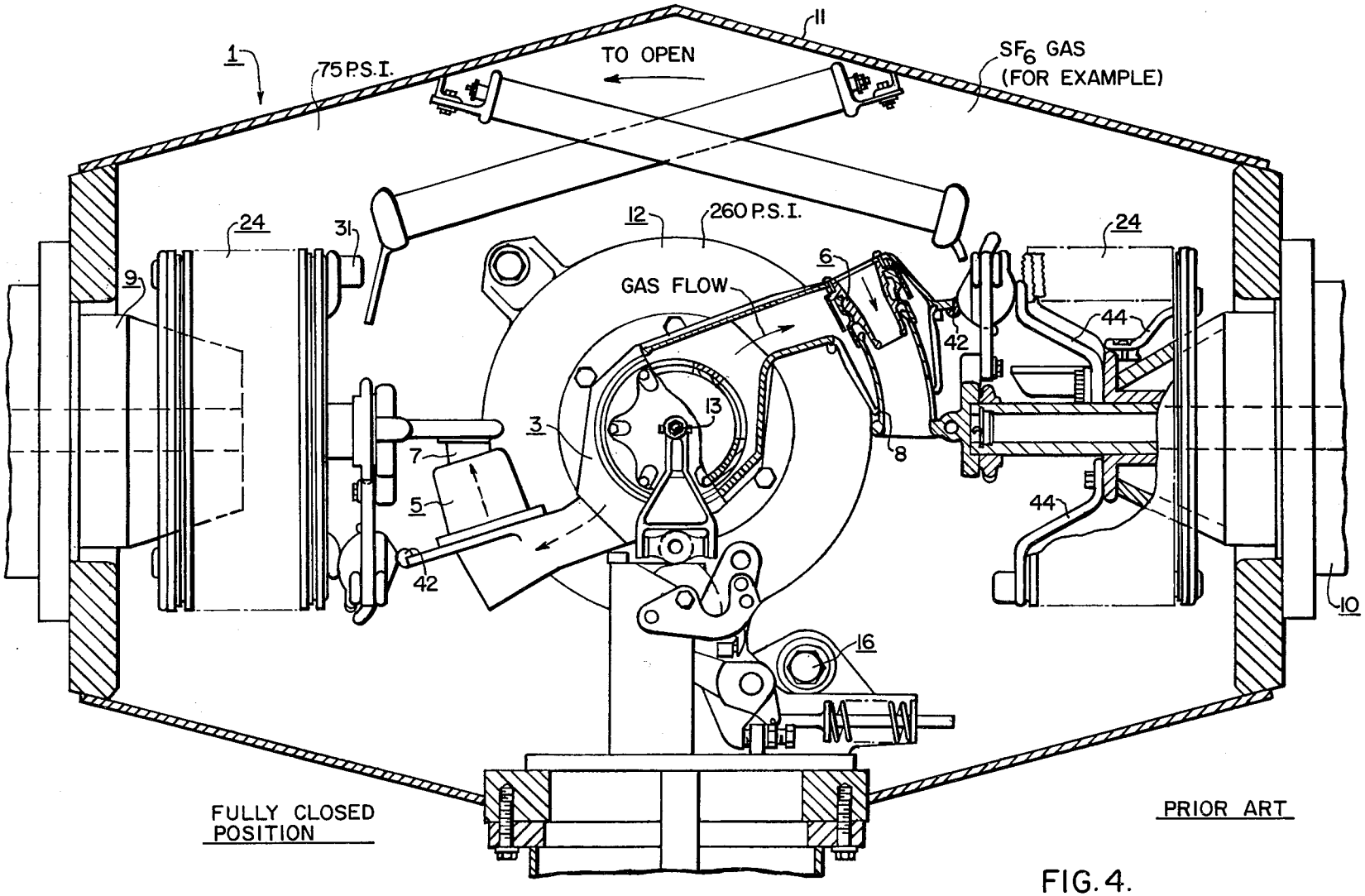
FIG. 4 is a considerably-enlarged sectional view taken through one of the interrupting heads of the interrupter of the prior art, indicating the contact structure therein in the closed-circuit position.

Referring to the drawings, and more particularly to FIGS. 1–7 thereof, it will be observed that there is provided a high-voltage three-phase compressed-gas circuit-interrupter 1 of the type set forth in U.S. Pat. No. 3,457,530, issued July 22, 1969 to R. C. Van Sickle, and assigned to the assignee of the instant application. Generally, the contact construction of the high-voltage interrupter of FIGS. 1–3 is set forth in FIG. 4, which shows the rotating movable contact-arm construction 3, in which a pair of serially-related movable contacts 5, 6 are separable from a pair of spaced relatively-stationary contacts 7, 8, the latter being connected to the inner ends of a pair of terminal-bushings 9, 10, extending latterly outwardly through a metallic interrupter casing 11. During the opening operation, and as set forth in said U.S. Pat. No. 3,457,530, the two movable contacts 5, 6 separate from the two relatively-stationary contacts 7, 8, drawing two arcs in series, and establishing a gas-flow from a high-pressure gas-reservoir chamber 12, extending on the axis 13 of the movable contact assembly 3. Reference may again be made to said U.S. Pat. No. 3,457,530 for a detailed description.

It will be observed, with reference to FIG. 4, that in the closed-circuit position of the contact structure of FIG. 4, that the contacts 5, 6 are under considerable accelerating spring pressure tending to effect their opening motion. This is not only provided by a pair of "tail" springs associated with the ground-operating mechanism 15, but, importantly, a heavy torsion-bar 16, as set forth more clearly in FIG. 4, is provided to enable a tremendous accelerating "kickoff" spring action at the contact structure itself enabling a very fast initial opening operation to be achieved, which, subsequently, is carried out by the aforementioned "tail" springs, disposed at the ends of the ground-operating rods at ground potential.

Figure 5:
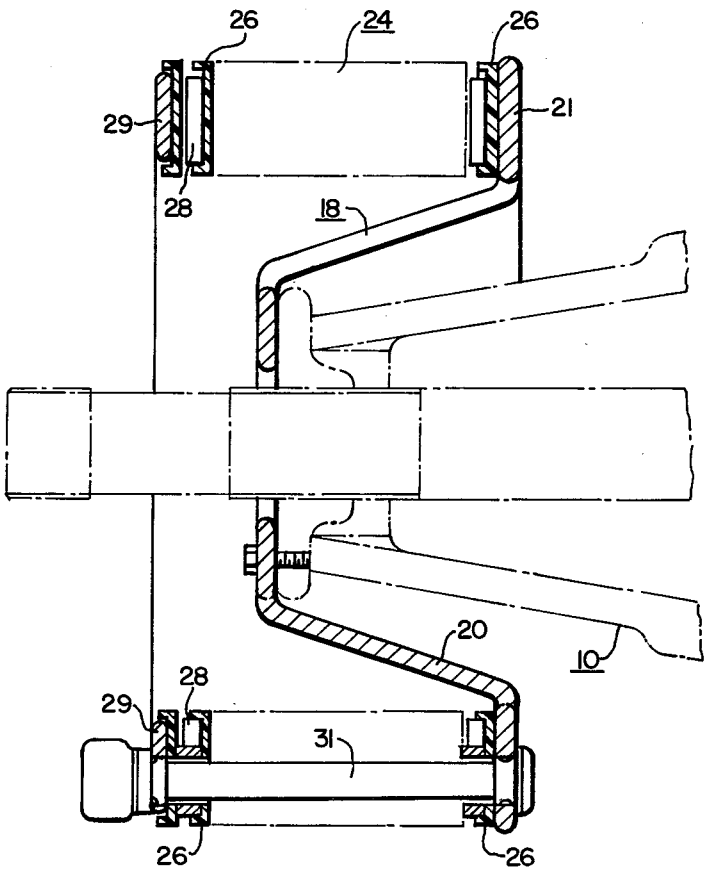
FIG. 5 is a vertical sectional view taken through the improved resistor support plate of the present invention.
Figure 6:
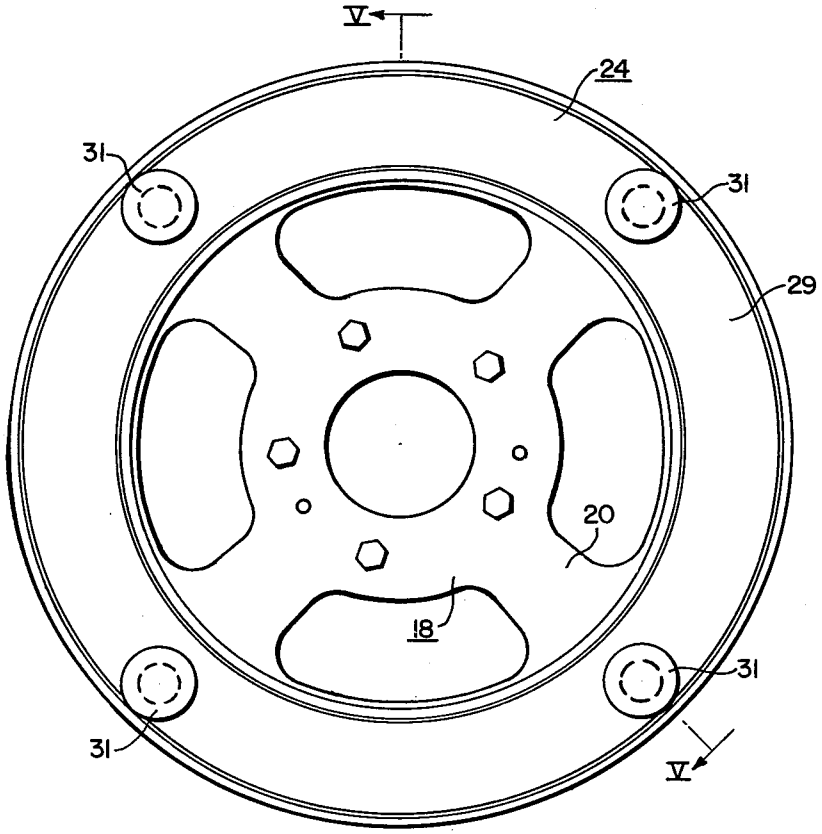
FIG. 6 is a front elevational view of the improved resistor support plate of FIG. 5; and, FIG. 7 is a somewhat diagrammatic enlarged view illustrating the pivotal movable resistor contact and the improved closing resistor support plate of the present invention.
Figure 7:
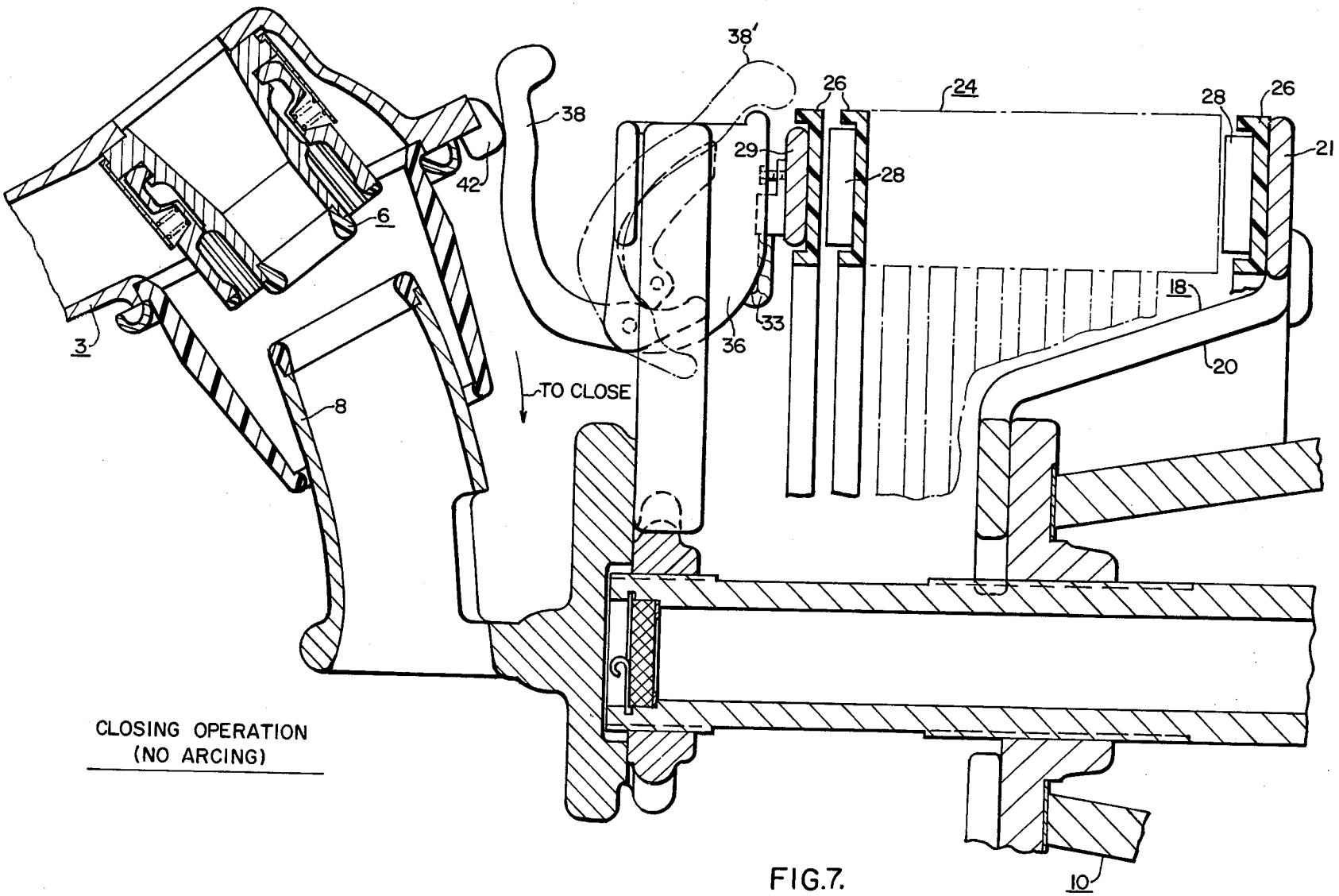

FIGS. 5–7 illustrate the improved resistor support 18 of the present invention. With particular reference being directed to FIGS. 5 and 6, it will be apparent that there is provided a rearwardly-extending spider-like metallic support plate 20 having a rear-shaped annular support 21 serving as the rear support for the circular closing resistor assemblage 24. The details of the resistor assemblage 24 are not shown, but reference may be made to U.S. Pat. No. 3,074,042, G. McNeir et al, issued Jan. 15, 1963, indicating the general manner of buildup of the closing resistor assemblage 24. Generally, it comprises a plurality of insulating troughs 26, within which are placed in circular fashion zigzag resistor conducting ribbons 28, which are connected in series, and, ultimately, to the front metallic ring-shaped support 29. The front ring-shaped metallic support 29 provides uniform compression of the several insulating troughs 26, and additionally provides a support for the four tie-bolts 31, which extend longitudinally through the resistor stack 24.

With reference to FIG. 7, it will be observed that a flexible connection 33 electrically interconnects the front ring-shaped metallic pressure plate 29 to a stationary casting 36, which may be, for example, of aluminum, within which pivotally rotates the closing resistor contact 38. FIG. 7 shows the rotatable resistor contact 38 in its normal position interfering during the closing operation of the interrupter 1.

During the opening operation, the counterclockwise rotative action of the cross-arm assembly 3 is so fast as to draw an arc (not shown) between the stationary and movable main contacts 6, 8, prior to any possible initial rotation of the rotatable resistor contact 38. The net result is that accordingly the resistor assemblage 24 is out of the circuit during opening, and has no function whatsoever during the opening operation of the circuit-breaker 1.

In the open-circuit position of the breaker 1, however, the rotatable resistor contact 38 is spring-biased into its normal obstructing position in the open-circuit position of the breaker as shown in FIG. 7, and is contacted during a subsequent closing operation by a movable resistor contact nub 42, which is a part of the moving contact assembly 3. Thus, during the closing operation as shown in FIG. 7, such a resistor contact nub 42 contacts physically the rotatable contact 38, and forces it out of the way to the non-obstructed position, as illustrated by the dotted lines in FIG. 7 of the drawings.

By the utilization of the simplified resistor support plate 20, as described hereinbefore, it will be observed that all of the prior-art insulating supporting straps, 44 (FIG. 4), which were used heretofore with the older constructions, are completely eliminated. These insulating supporting straps 44 constituted somewhat of a hazard with regard to voltage breakdown during the closing operation of the breaker 1, and impeded the capability of the breaker 1 to withstand very high voltages. As well known by those skilled in the art, in high voltage-breakers, during the closing operation thereof, the resistor components must be able to withstand very high voltages produced by lack of simultaneous resistor insertions in a multiple break design. The formerly-used insulating straps 44 (FIG. 4) were somewhat susceptible to a voltage breakdown. However, with the new construction, as set forth in FIGS. 5 and 6 of the drawings, there is merely provided the rearwardly-extending metallic support plate 20, which not only supports the resistor assemblage 24 adequately, but eliminates the need for any additional insulating straps. Moreover, such a metallic support plate 20 provides the electrical connection itself to the rear end of the resistor assemblage 24.

Finally, the ring-shaped compression-plate 29 at the front end of the resistor assemblage 24 provides not only uniform compression of the resistor ribbon coils 28, but, additionally, provides a desirable contact from the front end of the resistor coil 24 to the stationary support casting 36, which rotatably supports the resistor contact 38 itself.

Although there has been illustrated and described a specific structure, it is to be clearly understood that the same was merely for the purpose of illustration, and changes and modifications may readily be made therein by those skilled in the art, without departing from the spirit and scope of the invention.

I claim:

1. A high-voltage high-power compressed-gas circuit-breaker comprising, in combination, means defining separable contacts separable to establish an arc, a terminal-bushing having a terminal-stud, means defining an enclosing gas-filled metallic high-voltage interrupter-tank enclosing said separable contact means and having said terminal-bushing extending thereinto, means defining a circular closing resistor assemblage surrounding the inner protruding end of said terminal-bushing and terminal-stud and inserted only during the closing operation of the high-power circuit-breaker, means defining a one-piece, metallic, resistor support of generally truncated configuration, and having a relatively-small-diameter apertured, inner flat supporting plate portion surrounding the inner end of the bushing-stud and fixedly secured thereto, said metallic resistor-support additionally also having an outwardly extending rear flat annular resistor compressive supporting flange-plate portion (21) for solely supporting said annular closing resistor assemblage, and tie-rod means (31) extending generally parallel to the direction of the bushing-stud and passing through the annular closing resistor assemblage to terminate at said rear, flat annular compressive supporting-flange plate portion.

2. The combination according to claim 1, wherein a second circular metallic compression-plate surrounds the forward end of the circular resistor assemblage, and said plurality of tie-rods extend through said second circular compression-plate and through the annular resistor assemblage to the rear end thereof, and the rear end of said tie-rods terminating at the rear end of the metallic support plate at said annular support-flange-plate portion.

3. A high-voltage high-power compressed-gas circuit-breaker of the "live" tank-type, comprising, in combination, means defining an interrupting assemblage disposed high in the air and supported by an upstanding hollow insulating column structure, said interrupting assemblage comprising a hollow metallic high-voltage gas-filled interrupter tank having a pair of terminal-bushings extending thereinto adjacent opposite ends thereof, an internal rotatable cross-arm assemblage having two movable contact structures disposed adjacent the outer free ends of said internal rotatable cross arm assemblage, means defining a pair of relatively-stationary main contact structures disposed adjacent the inner ends of each of the two terminal-bushing structures, said two movable contact structures making contacting engagement with the two relatively-stationary contact structures to thereby complete the electrical circuit through the high-voltage circuit-interrupter, means defining an annular closing resistance assemblage inserted only during the closing operation of the high-power circuit-breaker and comprising a pair of laterally-spaced, annular, resistor elements provided around the inner ends of both terminal-bushings, means for electrically inserted the two closing annular resistance assemblages into the electrical circuit only during the closing operation of the circuit-breaker prior in point of time to the subsequent closing of the pair of separable main contact structures during such a closing operation, means defining a pair of one-piece, metallic resistor-supports of generally truncated configuration, each of said one-piece, metallic resistor-supports being secured adjacent the inner ends of the two terminal-bushing studs, each of said one-piece metallic resistor supports being of generally truncated configuration and having a relatively-small-diameter apertured inner flat supporting plate portion surrounding the inner end of the respective terminal-bushing stud and fixedly secured thereto, each of said generally-truncated one-piece metallic resistor supports additionally also having an outwardly extending rear flat annular resistor compressive supporting flange-plate portion for solely supporting the respective annular closing resistor assemblage associated with the respective terminal-bushing, each of said respective resistor-supports constituting the sole resistor-support for its respective annular closing resistance assemblage, one movable resistor contact for each annular closing resistor-assemblage electrically connected to front end of each respective annular closing-resistance assemblage, each of said two annular movable resistor contacts being interposed in the path of circular closing motion of the two main movable contact structures during the closing operation of the interrupter so as to be struck in contacting engagement by said two main movable contact structures during the closing operation prior in point of time to the subsequent closing of the two laterally-spaced separable main contact structures.

4. The combination according to claim 3, wherein each spring metallic support plate has a rear circular supporting portion supporting the rear end of the circular resistor assemblage, and a front-disposed circular metallic compression plate disposed adjacent the front end of each circular resistor assemblage to provide uniform compression on the resistance elements.

5. The combination according to claim 4, wherein a plurality of tie-rods extends longitudinally through each circular resistor assemblages and terminates adjacent said compression plate and also at the rear peripheral portion of the rearwardly-extending generally truncated metallic support plate.

* * * * *